United States Patent [19]

Tsuchiya

[11] Patent Number: 4,813,096

[45] Date of Patent: Mar. 21, 1989

[54] DEVICE FOR OPENING AND CLOSING DUST COLLECTING BOXES IN A CLEANER

[75] Inventor: Toshihiro Tsuchiya, Chiba, Japan

[73] Assignee: Kabushiki Kaisha Hoky, Chiba, Japan

[21] Appl. No.: 124,688

[22] Filed: Nov. 24, 1987

[30] Foreign Application Priority Data

Jul. 1, 1987 [JP] Japan ..... 62-101643[U]

[51] Int. Cl.[4] ..... H47L 11/33

[52] U.S. Cl. ..... 15/41 R

[58] Field of Search ..... 15/41 R–45, 15/48, 79 R, 79 A, 83

[56] References Cited

U.S. PATENT DOCUMENTS 481,829 8/1892 Sanford ..... 15/41 R
3,774,257 11/1973 Smyth et al. ..... 15/48

FOREIGN PATENT DOCUMENTS 677024 12/1929 France ..... 15/41 R
970409 6/1950 France ..... 15/41 R

*Primary Examiner*—Edward L. Roberts
*Attorney, Agent, or Firm*—Wenderoth, Lind & Ponack

[57] ABSTRACT

A rotational cleaning member is mounted transversely at the central portion of a casing, the bottom of which is opened, in a rotatable manner, and driving wheels are positioned on both the right and left sides of the casing to support the same on a floor and to impart a rotating force to the rotational cleaning member. Dust collecting boxes are disposed to the front and rear of the rotational cleaning member, and each of these dust collecting boxes is always urged by spring members in a closing direction thereof. Furthermore, a locking mechanism for imparting a prescribed damping resistance to the dust collecting boxes during opening and closing operations thereof and for maintaining an opened state thereof when the opening operation is completed is provided.

4 Claims, 4 Drawing Sheets

DEVICE FOR OPENING AND CLOSING DUST COLLECTING BOXES IN A CLEANER

FIELD OF THE INVENTION

This invention relates to a device for opening and closing dust collecting boxes in a cleaner, and particularly to a device for opening and closing dust collecting boxes in a cleaner wherein no rapid opening and closing operation occurs with respect to the dust collecting boxes.

DESCRIPTION OF THE RELATED ART

A conventional device for opening and closing a dust collecting box is disclosed in Japanese utility model publication No. 43256/1981 wherein opening and closing operations for the dust collecting box are controlled by means of linear spring members each having an inverted U-shaped profile. More specifically, these spring members always urge the dust collecting box in a closing direction thereof when such is in a closed condition. On the other hand, when the dust collecting box is opened at a certain angle or more, the spring members resiliently urge the dust collecting box in a direction in which the dust collecting box becomes more opened and hence, when the dust collecting box reaches a prescribed angle, the dust collecting box abuts against a stopper to limit the opening operation. Since the dust collecting box is always urged by means of the spring members in the opening direction, the dust collecting box can maintain the opened condition.

Because of the opening and closing operations as described above, it is possible to discharge dust collected.

According to the conventional device for opening and closing a dust collecting box, however, when the dust collecting device is opened at an angle exceeding a prescribed angle when discharging collected dust, the dust collecting box is resiliently opened by means of the urging force exerted by the spring members in the direction to be opened, and as a result, fine dust is blown out because of shock in the case when the dust collecting box abuts upon its stopper. Thus, a working area is contaminated by such dust, bringing about an unhealthy condition in which such dust is inhaled by an operator and the like. Particularly, since the dust collected in a dust collecting box includes fine dust in most cases, a condition in which dust is blown out has been a serious problem for the operator of a cleaner.

OBJECT AND SUMMARY OF THE INVENTION

The present invention has been made in view of the above, and for the sake of eliminating rapid opening and closing operations of a dust collecting box to obviate shock which is produced when the dust collecting box abuts upon a casing or a stopper when the opening and closing operations are completed. The invention provides a device for opening and closing such dust collecting boxes wherein each dust collecting box is always urged by means of spring members in the closing direction thereof and a locking mechanism affords a prescribed damping resistance to the dust collecting box during the opening and closing operations thereof and maintains an opened condition thereof.

Namely, a device for opening and closing a dust collecting box in a cleaner according to the present invention is constructed such that the dust collecting box is always urged by means of spring members stretched between its casing and said dust collecting box in the closing direction thereof, and further a locking mechanism for affording a damping resistance to the dust collecting box during the opening and closing operations thereof and for maintaining the condition at the completion of an opening operation is provided, whereby the dust collecting box is opened against the urging force of the spring members. Accordingly, rapid opening and closing operations are not produced due to the resiliency of the spring members in the present cleaner.

BRIEF DESCRIPTION OF THE DRAWINGS

The drawings illustrate an example of a device for opening and closing dust collecting boxes in the cleaner according to the present invention in which.

DETAILED DESCRIPTION OF THE PREFERRED EMBODIMENT

Figure 1:
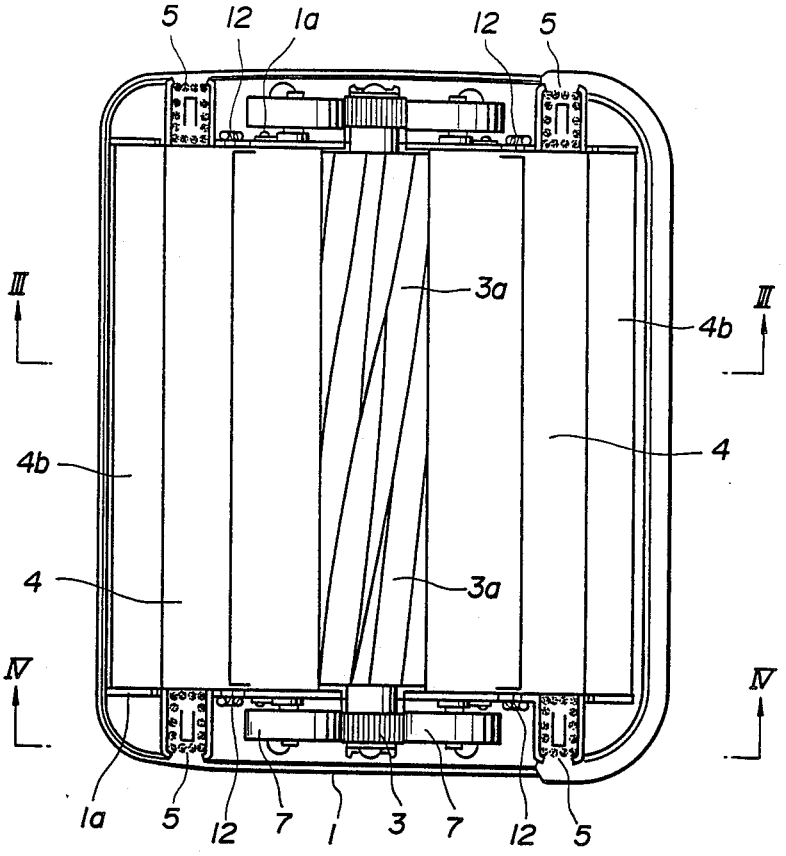
FIG. 1 is a bottom view showing the device for opening and closing dust collecting boxes in the cleaner.
Figure 2:
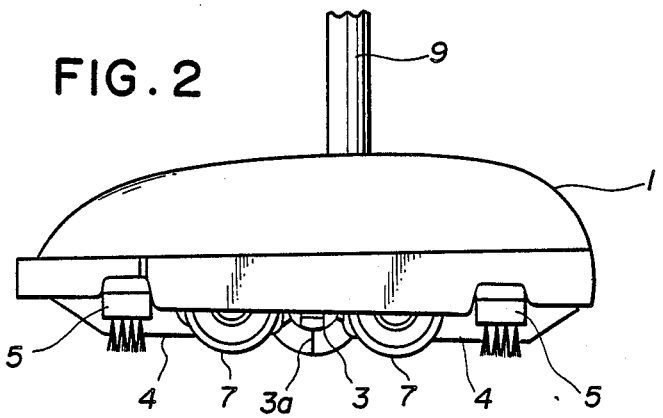
FIG. 2 is a side view showing the device for opening and closing dust collecting boxes in the cleaner.

An opening and closing device for a dust collecting box in the cleaner according to the present invention will be described in detail hereinbelow by referring to the accompanying drawings.

The cleaner of the invention comprises a casing 1, the bottom of which is open and provided with partition walls 1*a*, 1*a* on the opposite sides thereof, a rotational cleaning member 3 which is suspended in a vertically movable and rotatable manner by means of dampers 2, 2 each of which is disposed at a substantially central portion of each partition wall 1*a*, said rotational cleaning member 3 being provided with a plurality of blades 3*a* in the central portion thereof, and the cleaning member 3 being transversely mounted in the central portion of the casing 1, dust collecting boxes 4, 4 which are disposed to the front and rear of the rotational cleaning member 3, respectively, and extend between the opposite partition walls 1*a* and 1*a*, corner brushes 5, 5, 5, 5 each of which is integrally formed with one of the dust collecting boxes 4, 4 and extends between an end of the casing 1 and said one of the partition walls 1*a*, 1*a*, driving wheels 7, 7, 7, 7 each of which is positioned between an end of the casing 1 and one of the partition walls 1*a*, 1*a*, and is suspended rotatably by brackets 6, 6, 6, 6 mounted on respective ones of the partition walls 1*a*, 1*a* for imparting a rotational force to the rotational cleaning member 3 and at the same time, for supporting the casing 1 on a floor, a joint 8 disposed movably on a roof portion of the casing 1, and a travelling handle 9 connected to the joint 8. Each dust collecting box 4 is mounted to a revolving shaft 4*a* extending in a direction defined between the partition walls 1*a*, 1*a* and extends in an elongated hole 10 defining a shaft bush opening. The bush opening extends vertically in partition wall 1*a*, and a rear edge 4*b* of the dust collecting box 4 can be rotated around the revolving shaft 4*a* towards the lower part of the casing 1, whereby the dust collecting box may be freely opened and closed. A front edge of each dust collecting box 4 defines a leading edge 4c for guiding dust into the dust collecting box 4.

Figure 3:
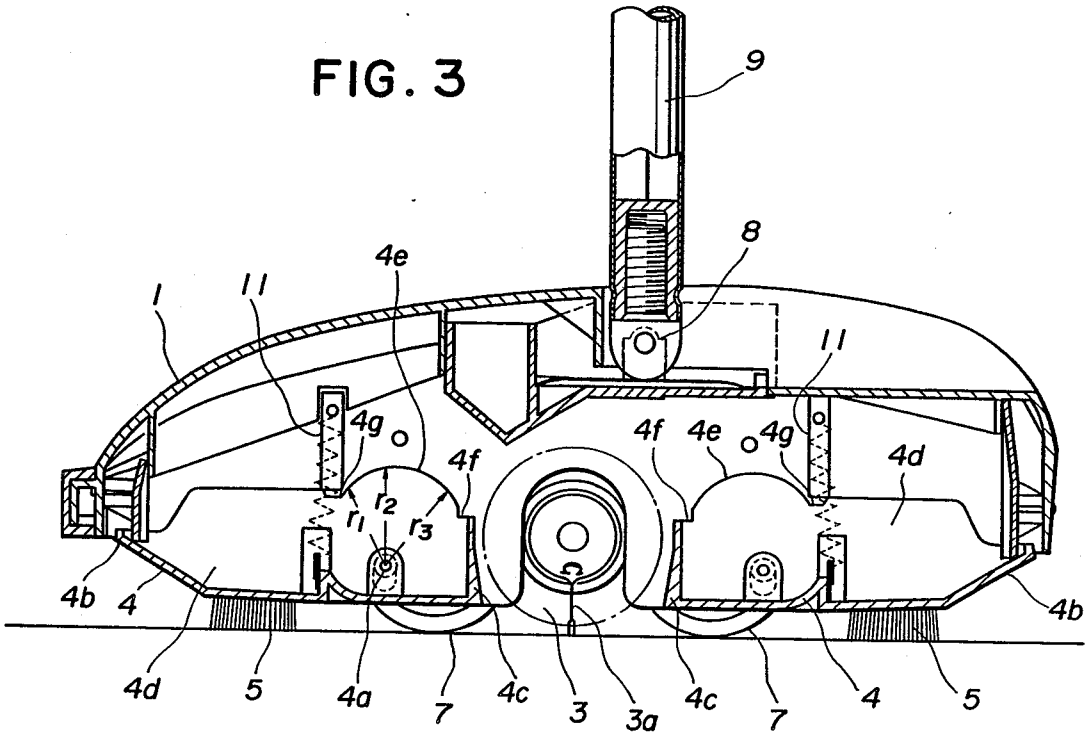
FIG. 3 is a sectional view in elevation, taken along the line III—III of FIG. 1.
Figure 4:
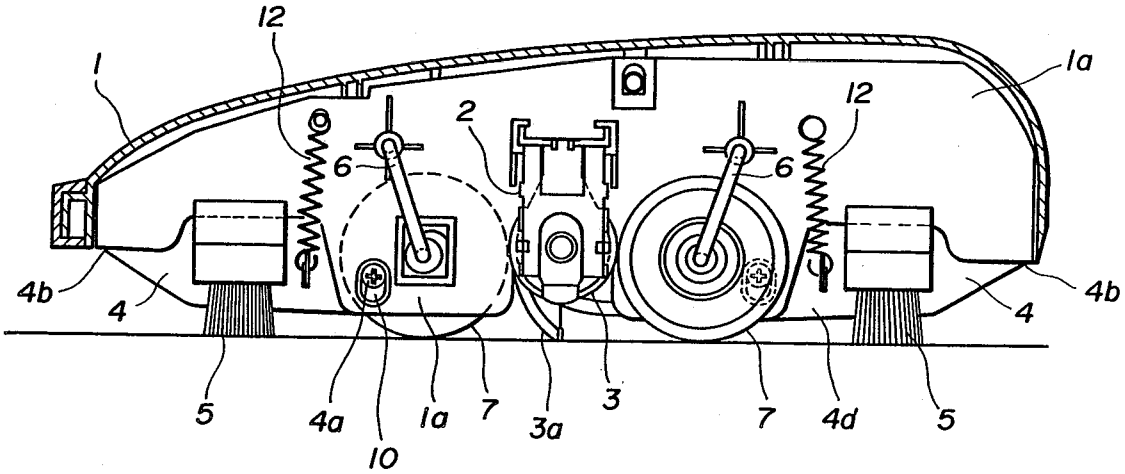
FIG. 4 is a sectional view, in elevation, taken along the line IV—IV of FIG. 1 wherein the front driving wheels are not shown for the sake of clarity.

At the upper edge of each side wall 4d of a dust collecting box 4, an eccentric circular arcuate cam portion 4e is formed, the eccentric circular arcuate cam portion 4e having a radius which becomes larger from the rear edge to the front edge thereof ($r_1<r_2<r_3$) around the revolving shaft as the center thereof as shown in FIG. 3, and a notched portion 4f is formed in the vicinity of a joint portion of the eccentric circular arcuate cam portion 4e and a leading edge 4c. Furthermore, each notched portion 4g is also defined on a rear edge side of a circular arcuate cam portion 4e, and each projection 11 is suspended from a partition wall 1a immediately over the notched portion 4g so as to form a locking mechanism. A spring member 12 is positioned between the casing 1 and each partition wall 1a, and an upper end of the spring member is fixed at a location corresponding to that at which a proximal portion of a projection 11 is disposed on the outer side of the partition wall 1a, while a lower edge thereof engages at a location somewhat nearer to a rear edge side than is a notched portion 4g, the lower part of the outer side of a side wall 4d, whereby the spring member 12 is stretched between the casing 1 and a dust collecting box 4. Each spring member 12 is always urged in a direction tending to close a dust collecting box 4, and in its normal state, the dust collecting box 4 is closed by this urging force of the spring member 12.

Figure 5:
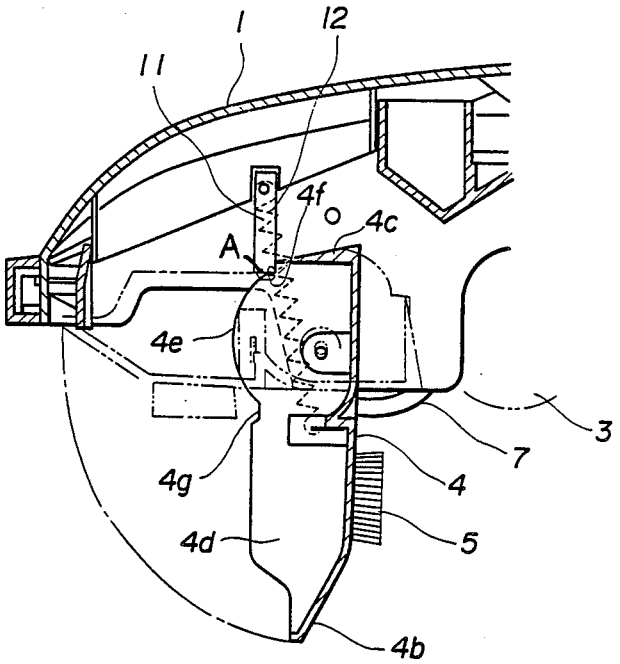
FIG. 5 is an explanatory diagram illustrating opening and closing operations for a dust collecting box.

When an operator intends to discharge dust which is contained in each of the dust collecting boxes 4, 4 as a result of a cleaning operation, an opening operation of the dust collecting box 4 is performed in which the operator holds either the rear edge portion 4b of the dust collecting box 4 or the corner brushes 5, 5 and the like disposed integrally with a rear portion of the dust collecting box 4 to pivot the dust collecting box 4 downwardly around its revolving shaft 4a against the urging force of a spring member 12. In this case, after the opening operation is performed as a result of the downward revolution of the rear edge portion 4b of the dust collecting box 4, eccentric circular arcuate cam portion 4e abuts projection 11. At the same time, the revolving shaft 4a moves downward in elongated hole 10, whereby the eccentric circular arcuate cam portion 4e slides under the projection 11 to permit the dust collecting box 4 to move towards a lower position. A dimension of the elongated hole 10 is such that the revolving shaft 4a is positioned at the lowest position in the elongated hole 10 when the radius r of the eccentric circular arcuate cam portion 4e abutting projection 11 is the largest radius $r_3$. When the dust collecting box 4 is further pivoted, the projection 11 engages with its notch 4f as shown in FIG. 5 to complete the opening operation. Since an engaged site A is positioned on a straight line coincident with spring member 12, a meshing condition of the projection 11 with the notch 4f is maintained by the contracting force of the spring member 12 so that the opened state is maintained. In other words, since the operation for opening the dust collecting box 4 always occurs against urging force of the spring member 12, such an opening operation can be effected at a desired rate, so that the dust collecting box 4 can be opened easily at a very slow constant speed, and the opened state can be maintained. In order to return the dust collecting box 4 from the opened state shown in FIG. 5 to the closed state shown in FIGS. 1, 2, 3, and 4, operations reverse to those described above may be taken. More specifically, when the dust collecting box 4 is upwardly, its rear edge portion 4b engages the casing 1 to realize the closed state. In this case also, since projection 11 abuts upon and slides under concentric circular arcuate cam portion 4e, a rapid closing operation can be prevented.

As described above, in accordance with the device for opening and closing a dust collecting box in a cleaner of the present invention, since each dust collecting box is always urged by each spring member to maintain a closed condition with respect to the casing and in addition, and since a cam locking mechanism is provided, the dust collecting box can be opened and closed at a slow constant rate.

I claim:

1. In a cleaner including a casing having an open bottom, opposite side walls, a front portion, a rear portion opposite said front portion and a central portion defined between said front and said rear portions, a rotational cleaning member extending between said side walls at the central portion of said casing and rotatably mounted therein for sweeping up dust and the like from a floor, driving wheels disposed at both of said side walls for supporting said casing on a floor and operatively connected to said rotational cleaning member for imparting a rotational force thereto, and dust collecting boxes disposed, respectively, at the front and the rear portions of said casing for receiving dust swept off of a floor by said rotational cleaning member, the dust collecting boxes each movably mounted to said casing so as to be movable between respective open and closed positions thereof, the improvement comprising:

spring means connected to each of said dust collecting boxes, said spring means constantly exerting an urging force on each of said dust collecting boxes that urges said dust collecting boxes to said closed positions thereof as said dust collecting boxes are moved between said open and closed positions thereof; and a locking mechanism means cooperating with each of said dust collecting boxes for exerting a predetermined damping force thereon that retards the urging force exerted by said spring means, respectively, as each of said dust collecting boxes is moved between the open and the closed positions thereof, and for releasably fixing each of said dust collecting boxes in the open position thereof, respectively, when said each of said dust collecting boxes is moved to the open position thereof.

2. An improvement in a cleaner as claimed in claim 1, wherein each of said dust collecting boxes has a cammed surface defined thereon, and each said locking mechanism means comprises a fixed camming mechanism integral with said casing and engaging the cammed surface defined on a respective one of said dust collecting boxes as said respective one of said dust collecting boxes is moved between the open and closed positions thereof.

3. An improvement in a cleaner as claimed in claim 1, wherein said casing has an elongated hole extending therein at said front portion thereof adjacent one of said dust collecting boxes and at said rear portion thereof adjacent the other of said dust collecting boxes, each of said dust collecting boxes has a pivot shaft extending in the respective one of said elongated holes adjacent thereto, said pivot shaft disposed in an upper portion of said respective one of said elongated holes when the dust collecting box is in the closed position thereof, a cammed surface having a radius of curvature that varies about said pivot shaft when disposed in the upper portion of said respective one of said elongated holes, and a notched portion adjacent said cammed surface, and each of said locking mechanism means comprises a projection fixed relative said casing and engaging said cammed surface defined on a respective one of said dust collecting boxes when said respective one of said dust collecting boxes is moved between the open and closed positions thereof, and said projection engaging said notched portion of said respective one of said dust collecting boxes when said respective one of said dust collecting boxes is in said open position thereof.

4. In a cleaner including a casing having an open bottom, opposite side walls, a front portion, a rear portion opposite said front portion and a central portion defined between said front and said rear portions, a rotational cleaning member extending between said side walls at the central portion of said casing and rotatably mounted therein for sweeping up dust and the like from a floor, driving wheels disposed at both of said side walls for supporting said casing on a floor and operatively connected to said rotational cleaning member for imparting a rotational force thereto, and dust collecting boxes disposed, respectively, at the front and the rear portions of said casing for receiving dust swept off of a floor by said rotational cleaning member, the dust collecting boxes each movably mounted to said casing so as to be movable between respective open and closed positions thereof, the improvement comprising:

spring members connected, respectively, between said casing and each of said dust collecting boxes, said spring members constantly exerting an urging force on each of said dust collecting boxes that urges said dust collecting boxes to said closed positions thereof as said dust collecting boxes are moved between said open and closed positions thereof; and said casing having an elongated hole extending therein at said front portion thereof adjacent one of said dust collecting boxes and at said rear portion thereof adjacent the other of said dust collecting boxes, each of said dust collecting boxes having a pivot shaft extending in the respective one of said elongated holes adjacent thereto, said pivot shaft disposed in an upper portion of said respective one of said elongated holes when the dust collecting box is in the closed position thereof, a cammed surface having a radius of curvature that varies about said pivot shaft when disposed in the upper portion of said respective one of said elongated holes, and a notched portion adjacent said cammed surface; and projections fixed relative said casing and relatively engaging said cammed surfaces defined on said dust collecting boxes when said dust collecting boxes are moved between the open and closed positions thereof, said projections respectively engaging said notched portions of said dust collecting boxes when said dust collecting boxes are in said open positions thereof.

* * * * *